United States Patent [19]

Lofstrand

[11] Patent Number: 4,595,811

[45] Date of Patent: Jun. 17, 1986

[54] SWITCH CONTACT ELEMENT RETAINING MEANS AND METHOD OF ASSEMBLY

[75] Inventor: Warren A. Lofstrand, Enfield, Conn.

[73] Assignee: Cooper Industries, Inc., Houston, Tex.

[21] Appl. No.: 770,812

[22] Filed: Aug. 29, 1985

[51] Int. Cl.[4] ..... H01H 1/58

[52] U.S. Cl. ..... 200/284; 29/844; 339/263 R; 339/272 A

[58] Field of Search ..... 200/284; 339/263 R, 339/272 R, 272 A; 29/842, 844, 845, 854

[56] References Cited

U.S. PATENT DOCUMENTS

| | | | |
|---|---|---|---|
| 2,622,119 | 12/1952 | Hubbell | 339/272 A |
| 3,944,773 | 3/1976 | Schumacher | 200/284 |
| 4,410,232 | 10/1983 | Murray | 29/844 |

*Primary Examiner*—Stephen Marcus
*Assistant Examiner*—Renee S. Luebke
*Attorney, Agent, or Firm*—Eddie E. Scott; Nelson A. Blish; Alan R. Thiele

[57] ABSTRACT

An electrical contactor device has a molded insulating body base member with at least one boss having a bore extending from a contact element support surface. A stationary contact element having a generally planar plate portion and a projection extending from said plate portion adjacent, in a bent condition, to a terminal screw receiving boss is positioned on the boss of said base member and the terminal receiving screw is threaded into engagement with the contact element to assemble the contact element with the screw and to simultaneously bend the projection into a keyway formed in the bore to secure the contact element to the base member. A second projection adjacent the first projection is of substantially greater width than the first projection and is permanently bent into a position for engagement with a shelf extending from a portion of the base member adjacent to the bore to assist in securing the contact element to the base member.

12 Claims, 6 Drawing Figures

SWITCH CONTACT ELEMENT RETAINING MEANS AND METHOD OF ASSEMBLY

BACKGROUND OF THE INVENTION

1. Field of the Invention

The present invention pertains to an electrical switch or contactor element which is retained in assembly with a supporting base by an integral member which is displaced into a retaining position upon assembly of the contact element to the supporting base. The invention includes the method of assembly of the unique contact element.

2. Background

Mechanically and electromagnetically actuated electrical switched or contactors are often rather mechanically complicated devices requiring several parts such as stationary and movable contact elements, biasing springs, actuating devices and provisions for connecting electrical conductor lead wires to the switch or contactor apparatus itself. In the manufacture of these devices there is an ever present need to improve the ease with which the devices are initially assembled and also give consideration to the variety of electrical conductor wire terminal elements which are used in connecting switch devices to an electrical circuit.

In the manufacture of electromagnetically actuated electrical switches or contactors, for example, it has heretofore been conventional practice to provide one or more so called stationary contact elements which also serve as terminals for connecting electrical conductor lead wires to the contactor device itself. In this regard prior art practice includes the provision of conventional threaded fasteners for securing the contact element to an insulated base member and also providing separate threaded fasteners used as terminal connecting means for connecting a lead wire to the contact element. In the interest of reducing the cost of manufacturing and assembling electrical contactor devices, it has been deemed desirable to minimize the number of fasteners required in manufacturing and assembling the various parts of the contactor device while yet achieving all of the functional requirements of these devices.

In some applications of these devices inexperienced personnel may remove the wrong fastener when preparing to connect an electrical lead wire to the stationary contactor element thereby inadvertently disconnecting or allowing the stationary contactor element to fall out of its intended position secured to the insulating body. If the wrong fastener is used as a terminal securing means the lead wire may be located in an incorrect position with regard to adjacent structure such as covers or shrouding for the contactor device itself. Accordingly, the present invention is directed to providing a unique arrangement of a stationary contact element secured to a base member of a switch or contactor device and to an improved method of assembling a stationary contact element with respect to a supporting base or similar structure.

SUMMARY OF THE INVENTION

The present invention provides an improved electrical switch or contactor device having a stationary contact element which is secured to a support base or frame portion of the device by displacement of an elongated portion of the contact element itself on assembly to retain the contact element permanently attached to the base or frame member.

In accordance with an important aspect of the present invention the contact element is provided with an internally threaded boss or nut portion for receiving a screw in threaded engagement therewith and, upon insertion of the screw in engagement with the contact element, an elongated projection or tab portion of the contact element is bent into locking engagement with the supporting base member of the contactor device. Accordingly, upon removal of the screw the contact element remains in position secured to the base member to prevent unwanted separation of the contact element from the contactor device. In this way a stationary contact element is provided which is secured to a supporting frame or base member upon assembly therewith by utilization of a terminal connecting screw and no additional fastener means are required for use in securing the contact element or elements to the base member.

In accordance with still a further aspect of the present invention there is provided and improved method of assembling a stationary contact element to a supporting base member for an electrical switch or contactor device wherein there is provided a contact element having an elongated bendable tab or projection. The contact element is placed in position on the base member and a threaded terminal connecting screw or similar member is used to displace the projection or tab into locking engagement with the supporting frame or base member in an operation which combines the assembly of the contact element with the base member and attachment of the terminal connecting screw to the contact element itself.

Those skilled in the art will recognize the above described features and advantages of the present invention together with additional superior aspects thereof upon reading the detailed description which follows in conjunction with the drawing.

DESCRIPTION OF A PREFERRED EMBODIMENT

Figure 1:
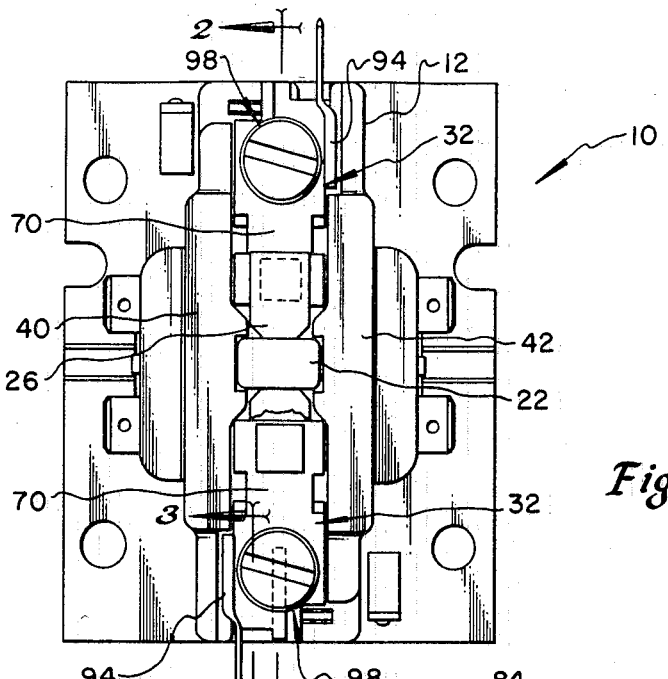
FIG. 1 is a from elevation of an electromagnetically actuated switch or contactor in accordance with the present invention.

In the description which follows like parts are marked throughout the specification and drawing with the same reference numerals, respectively. The drawing figures are not necessarily to scale and certain features of the invention may be shown exaggerated in scale in the interest of clarity.

Figure 2:
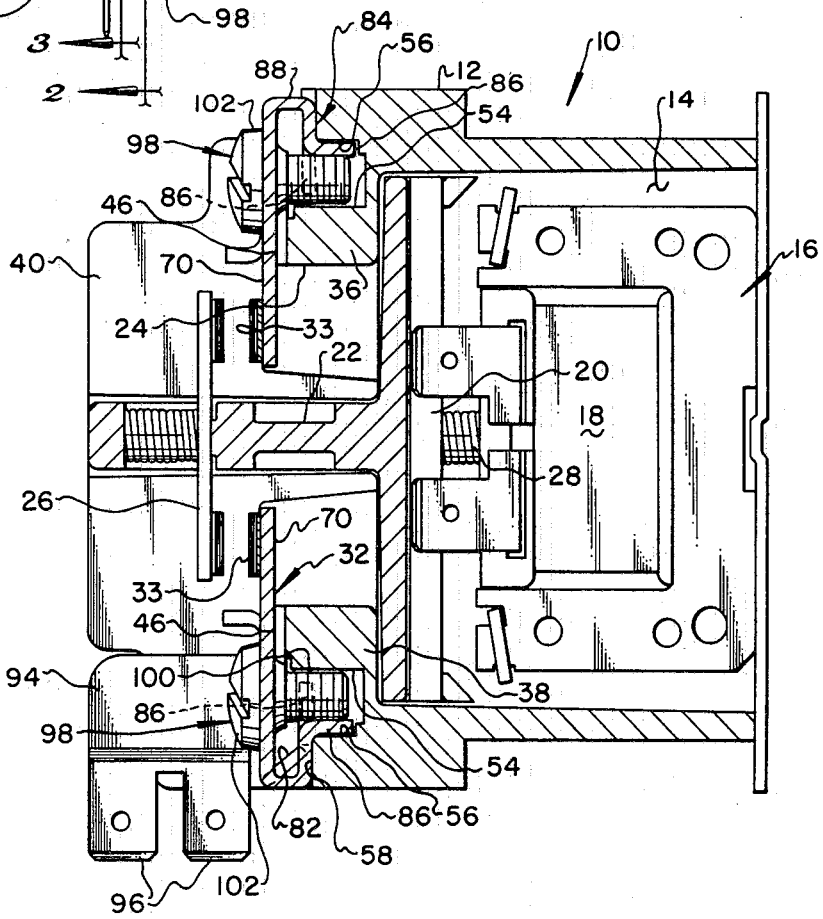
FIG. 2 is a section view taken generally along the Line 2—2 of FIG. 1.

Referring to FIGS. 1 and 2, there is illustrated a magnetic contactor, generally designated by the numeral 10. The contactor 10 is an electromagnetically actuated switch of the general type used for motor starting applications and other relatively heavy duty applications in high voltage electrical circuits. The contactor device 10 includes a molded plastic base 12 forming an enclosure 14 for an actuator, generally designated by the numeral 16, and including an electromagnet coil 18, and armature 20 and a molded plastic coupler member 22. The coupler member 22 projects through an opening 24 in the base member 12 and is suitably connected to a movable contact element 26. A return spring 28 biases the contact element 26 into the contactor open position illustrated in FIG. 2 and, in response to energizing the coil 18, the movable contact element 26 is brought into electrically conductive engagement with a pair of spaced apart stationary contact elements, each generally designated by the numeral 32. The general construction of the contactor device 10 heretofore described with the exception of the inventive features described herein, including the unique contact elements 32 and the modified base member 12, is believed to be readily understandable to those of skill in the art further description of the operation of the contactor 10 will not be made in the interest of conciseness.

Figure 4:
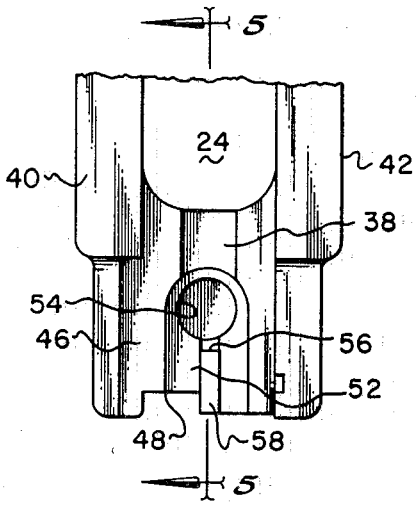
FIG. 4 is a detail elevation view of a portion of the conductor base member.
Figure 5:
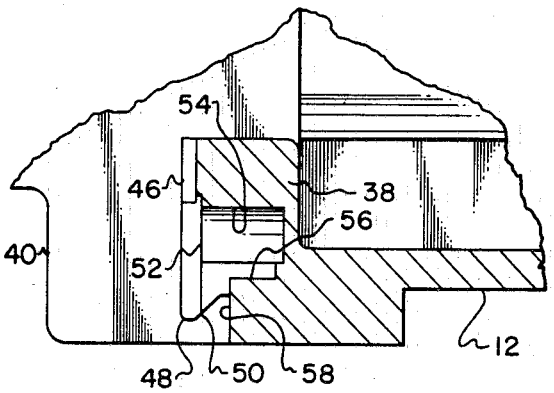
FIG. 5 is a detail section view of the contactor base member taken along the Line 5—5 of FIG. 4.

Referring further to FIG. 2 and also FIGS. 4 and 5, the base member 12 is characterized by a pair of integral spaced apart bosses 36 and 38 which define at least in part the opening 24. The opening 24 is further defined by spaced apart shields 40 and 42 also integrally molded as part of the base member 12. In FIGS. 4 and 5 only the boss 38 is illustrated in detail and it will be appreciated that the boss 36 is similarly configured in accordance with the following description for supporting one of the stationary contact elements 32.

Referring primarily to FIGS. 4 and 5, the boss 38 is defined by a generally planar surface 46 which projects downwardly, viewing FIG. 5, to form an overhanging shelf portion 48 having a reentrant edge 50. The surface 46 is preferably relieved by a countersunk surface 52 which intersects the shelf portion 48. A generally cylindrical bore 54 extends into the boss 38 and opens to the countersunk surface 52. An axial keyway 56 extends substantially the full depth of the bore 54 and opens into the bore. The keyway 56 includes a portion 58 extending normal to the longitudinal axis of the bore 54 and intersecting the keyway portion 56, as illustrated in FIGS. 4 and 5.

Figure 3:
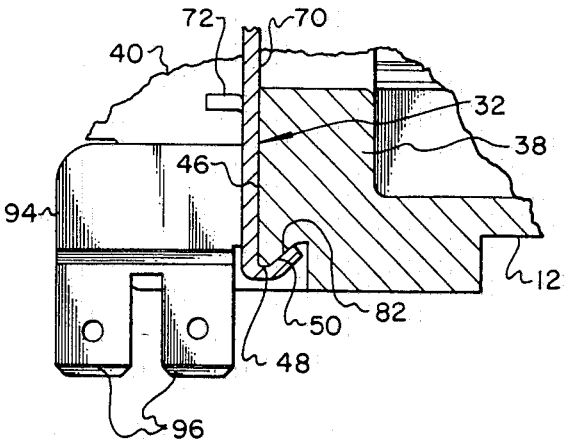
FIG. 3 is a detail section view taken along the Line 3—3 of FIG. 1.
Figure 6:
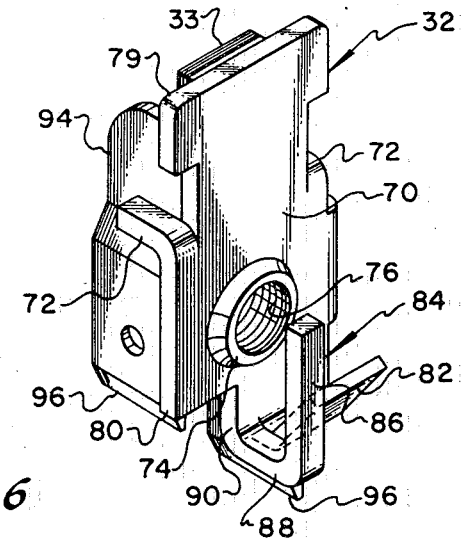
FIG. 6 is a perspective view of the contact element showing the locking tab in its initial position prior to assembly of the contact element to the base member.

Referring now to FIGS. 2, 3 and particularly FIG. 6, each of the contact elements 32 is comprised of a generally planar metal plate member 70 having a generally rectangular configuration and being formed by a suitable stamping or coining operation to have one or more terminal locating projections 72 arranged along a longitudinal side of the plate member 70. An integrally formed boss 74 is formed by displacing a portion of the plate member 70 and is provided with internal threads 76. The boss 74 may be formed by piercing the plate member 70 to form an opening in which the threads 76 may be formed or said opening may also be left unthreaded and adapted to receive a self-tapping type screw. The plate member 70 includes opposed transverse ends 79 and 80, the transverse end 80 having a first securing of locking tab or projection 82 extending therefrom and being bent in a generally "v" shaped configuration as illustrated in FIG. 3.

The plate member 70 includes a second relatively elongated securing tab or projection 84 which is bent into a generally "u" shaped configuration having a relatively long leg 86, base 88 and a second leg 90 integrally joined with the plate member 70. The projection leg 86 extends into a position, as illustrated in FIGS. 2 and 6, to be disposed at least partially across the opening in the boss 74 prior to assembly of the contact element 32 with the base member 12. As illustrated in FIG. 6, the width of the projection 82 is substantially greater than the width of the projection 84. Accordingly, bending efforts required to be exerted on either one of these projections to displace them from their original position, as illustrated in FIG. 6, would be substantially greater on the projection 82 than on the projection 84.

Each of the contact elements 32 includes a contact pad 33, FIG. 2, adapted to be engaged by the movable contact element 26 in response to actuation of the coupler 22. The contact elements 32 include a blade type terminal portion including an integral support part 94 and two spaced apart terminal blades 96, as shown in FIGS. 2 and 3, in particular. The contact elements 32 are also preferably provided with terminal anchoring screws 98, FIGS. 1 and 2, including shank portions 100 and relatively large area slotted heads 102. The screws 98 may be conventional machine screws of the panhead configuration or the like. The screws 98 are adapted to be threadedly engaged with the threads 76 of the contact element bosses for securing a terminal portion of a conductor lead wire, not shown, to the contact element 32. Moreover, in accordance with the present invention, upon assembly of the contact elements 32 to the bosses 36 and 38 the screws 98 are operable to displace the distal portions of the projection legs 86 into the key slots 56 to assume the positions illustrated in FIG. 2.

When the legs 86 of the projections 84 are bent into the position illustrated in FIG. 2 the contact elements 32 are disposed in the keyways 56, 58 and are secured to the respective bosses 36 and 38. This securing action may be accomplished by threading the screws 98 into the bosses 74. Alternatively, the displacement of the leg 86 of each projection 84 may also be accomplished by placing the contact element 32 in position in alignment with the keyway 56, 58 and performing the operation of tapping the opening to form the threads 76 wherein the tap member itself will perform the same displacement function as the shank 100 of the screw 98. As mentioned previously, the screw 98 could also be of the self-tapping type to simultaneously form internal threads on the boss 74 and displace the projection 84 into the contact element securing position.

Thanks to the provision of the projection 82, which is already bent to be in engagement with the shelf 48 when the projection 84 is bent into the keyway 56, the contact element 32 is prevented from movement either axially or radially relative to the longitudinal axis of the bore 54. Even though the screw 98 may be removed completely from the boss 74 the contact element 32 will not be disconnected from the base member 12.

If it is desired to remove the contact element 32 from the base member 12 the screw 98 is first removed from the boss 74 and the plate member 70 grasped near the transverse end 79 and bent forcibly away from the surface 46 to unbend the projection 82 relative to the plate member 70 to the extent that the projections 82 and 84 may be removed from engagement with their respective portions of the bosses 36 and 38, respectively. Actually, the aforementioned removal process is not preferred and, in applications where the bore 54 is a blind hole as illustrated in FIG. 2, the removal of the stationary contact elements 32 is not prescribed. Alternatively, the bores 54 and keyways 56 could be extended through the bosses 36 and 38 so that access to the distal end of the projection leg 86 may be obtained to bend the projection back to its initial position, upon removal of the screw 98 from the boss 74.

The configuration of the contact element 32 provides for an improved and unique method of assembly of a stationary contact element to a switch device or, in fact any electrical apparatus requiring a contact element which is adapted to receive a screw or tapping element as described above and illustrated in the accompanying drawing. In the preferred method of the invention the switch contact element 32 is provided with the projection 84 having the leg 86 initially bent into the position shown in FIG. 6 wherein the projection extends at least partially across the opening in the boss 74. The contact element 32 is then moved into position against the surface 46 without the presence of the screw 98 in the boss 74 by moving the contact element in a direction generally parallel to the surface 46 until the projection 82 is seated in full engagement with the shelf 48 and the lower portion of the leg 86 is disposed in the keyway portion 58. Normally, if the surface 46 is facing upwardly in a horizontal position the contact element 32 will remain in the position illustrated and described so that the screw 98 may then be inserted or a thread tap inserted into the opening in the boss 74 to commence displacement of the distal end of the leg 86 of the projection 84 to bend the end over and into the keyway 56. The screw 98 may then be removed or left in place as part of the contactor assembly. As will be appreciated by those skilled in the art when the screw 98 is removed from the boss 74 or even partially unthreaded, the contact element 32 will remain secured to the base member 12 firmly in the position determined by the registration of the projection 84 with the keyway 56, 58.

Those skilled in the art will appreciate from the foregoing description that a unique electrical switch or contactor, stationary contact element and method of assembly of same to a contactor base member is provided by the present invention. The parts described herein may be made of conventional engineering materials used for electrical switch contactors and motor starters, for example. Although preferred embodiments of the contactor, the contact element and the method of assembly have been described those skilled in the art will recognize that various substitutions and modifications may be made to the specific embodiments disclosed without departing from the scope and spirit of the invention as recited in the appended claims.

What I claim is:

1. An electrical contactor device having a base member including means forming a support surface thereon and a bore extending generally normal to said support surface, a longitudinal keyway opening into said bore and extending longitudinally thereof from said support surface, a contact element comprising a relatively flat plate portion and a first projection extending from said plate portion and being bendable relative to said plate portion, means defining and opening in said plate portion and located thereon in such a way that at least a portion of said first projection extends at least partially across said opening, said first projection being displaceable into said keyway be means extending through said opening for securing said contact element to said base member.

2. The contactor device set forth in claim 1, wherein: said contact element includes a second projection on said plate portion and being bent out of the plane of said plate portion, said base member including a portion engageable with said second projection for securing said contact element against movement relative to said base member when said first projection is bent into said keyway.

3. The contactor device set forth in claim 2, wherein: said second projection is disposed adjacent to said first projection and is of a configuration which requires a greater bending effort to displace said second projection relative to said plate portion than is required for displacement of at least a portion of said first projection relative to said plate portion.

4. The contactor device set forth in claim 2, wherein: said means forming said opening in said plate portion includes a boss, said boss including an internally threaded portion defining said opening for receiving a screw threadedly engaged with said boss and operable to displace said distal end of said first projection into said keyway.

5. The contactor device set forth in claim 2, wherein: said contact element includes a screw threadedly engageably with said contact element for securing a conductor terminal to said contact element, said screw being extendable into said bore to displace said first projection into said keyway for securing said contact element to said base member.

6. The contactor device set forth in claim 2, wherein: said base member includes at least two spaced apart bosses, each of said bosses including a contact element support surface, a bore extending into said boss and opening to said support surface, a keyway extending longitudinally in each of said bosses and opening to said bore and toward said support surface for receiving said first projection of each of said contact elements, respectively.

7. A contact element for an electrical contactor having a base member, said contact element comprising: a relatively flat plate portion and a first projection extending from said plate portion and being bendable relative to said plate portion, means defining an opening in said plate portion and located thereon in such a way that at least a portion of said first projection extends at least partially across said opening, said first projection being bendable by means extending through said opening for securing said contact element to said base member.

8. The contact element set forth in claim 7, including: a second projection extending from said plate portion and being bent out of the plane of said plate portion, said base member including a portion engageable with said second projection for securing said contact element against movement relative to said base member when said first projection is bent.

9. The contact element set forth in claim 8, wherein: said second projection is disposed adjacent to said first projection and is of a configuration which requires a greater bending effort to bend said second projection relative to said plate portion than is required for bending at least a portion of said first projection relative to said plate portion.

10. The contact element set forth in claim 8, wherein: said means forming said opening in said plate portion includes a boss, said boss including an internally threaded portion defining said opening for receiving a terminal securing screw threadedly engaged with said boss and operable to displace said distal end of said first projection into engagement with said base member.

11. A method of assembling an electrical contact element to a support base member of an electrical switch comprising the steps of:

providing a base member having a portion forming a bore opening to a support surface of said base member;

providing a contact element including a generally planar plate portion and an elongated projection extending from said plate portion and being bent to have a leg with a distal end extending at least partially across an opening formed in said plate portion;

positioning said contact element on said base member and supported on said surface; and displacing the distal end of said projection by insertion of means through said opening and into said bore for causing engagement of said projection with said base member to secure said contact element to said base member.

12. The method set forth in claim 11, wherein:

the step of extending means through said opening includes providing a terminal anchoring screw adapted to be threadedly engageable with means defining said opening in said contact element, and extending said screw into threaded engagement with said contact element and to forcibly bend said distal end of said projection into engagement with said base member.

* * * * *